United States Patent [19]

Jackson

[11] 4,213,376

[45] Jul. 22, 1980

[54] STORAGE AND FEEDING APPARATUS FOR AMMUNITION BELTS

[75] Inventor: Theodore A. Jackson, Utica, Mich.

[73] Assignee: Cadillac Gage Company, Warren, Mich.

[21] Appl. No.: 928,202

[22] Filed: Jul. 26, 1978

[51] Int. Cl.[2] ..... F41D 9/02

[52] U.S. Cl. ..... 89/34

[58] Field of Search ..... 89/33 BB, 33 BC, 34; 206/3

[56] References Cited

U.S. PATENT DOCUMENTS

| | | | |
|---|---|---|---|
| 2,452,545 | 11/1948 | Broga | 89/34 |
| 2,569,798 | 10/1951 | Carroll . | |
| 2,874,615 | 2/1959 | Kravik | 89/34 |
| 3,687,004 | 8/1972 | Faisander | 89/33 BB |

FOREIGN PATENT DOCUMENTS

| | | | |
|---|---|---|---|
| 639060 | 11/1938 | Fed. Rep. of Germany | 89/33 BB |
| 603774 | 4/1948 | United Kingdom | 89/33 BB |
| 759060 | 10/1956 | United Kingdom . | |

*Primary Examiner*—Stephen C. Bentley

*Attorney, Agent, or Firm*—Reising, Ethington, Barnard

[57] ABSTRACT

Apparatus (14) for storing and feeding an ammunition belt (16) is disclosed as including a storage compartment (22) for the belt which is adapted to feed an automatic gun upon belt movement through the compartment in a feed direction. Dividers (24) are spaced along the feed direction and are mounted, preferably on the compartment floor (28), for movement between first positions extending across the feed direction and second positions extending along the feed direction. In the first positions, the dividers allow storage of the ammunition belt in a serpentine configuration. Movement of the dividers to the second positions allows the ammunition belt to pass thereby upon movement to the gun. Each divider is mounted by a pivotal support (26) having a detent which initially locates the divider in the first position thereof during loading of the belt and which allows subsequent movement to the second position thereof after closing of a compartment closure. The preferred construction of the dividers includes a shaft (40) with a blade (38) secured thereto and the preferred construction of the pivotal supports includes a pair of bearings that receive shaft ends which extend from the divider blade. Spring clips (62) facilitate movement of the ammunition belt over the bearings.

14 Claims, 8 Drawing Figures

STORAGE AND FEEDING APPARATUS FOR AMMUNITION BELTS

TECHNICAL FIELD

This invention relates to apparatus for storing and feeding an ammunition belt to an automatic gun.

BACKGROUND ART

Automatic weapons such as guns are conventionally fired using an ammunition belt of connected shells. High speed firing of a large number of rounds is possible without reloading due to the large number of shells which can be connected as part of a single ammunition belt. The length of the belt is thus usually quite long and must be stored in other than a straight configuration so that the belt can be stored in a relatively compact compartment. Usually this storage is achieved by locating the belt in a curved or serpentine configuration with each length of the belt separated from the adjacent belt length by a fixed partition. The fixed partitions allow the belt to move freely to the gun without sliding over itself and possibly inhibiting the feed to the gun. Belt movement over itself can inhibit the feed by becoming caught or simply by increasing the force required to pull the belt to the gun. Prior art references which disclose apparatus of the type discussed above include British Patent Specification No. 759,060 and German Patentschrift No. 639,060.

U.S. Pat. No. 3,687,004 discloses feed apparatus for an automatic gun wherein an ammunition belt is driven by a servocontrol device. Belt tension is sensed by a detector in order to control operation of an electric motor of the servocontrol device. The belt tension detector includes spring biased levers carrying a roller than engages the ammunition belt to form a bight within a curved housing along the direction the belt is fed.

British Patent Specification No. 603,774 discloses an ammunition belt feed mechanism including rollers carried by a linkage which is retractable to position the belt in an abruptly curved configuration and which is extendable so that the belt curvature becomes less abrupt in order to feed the belt during operation of the gun.

Another gun feed mechanism is disclosed by U.S. Pat. No. 2,569,798. This mechanism does not require the shells which are loaded to be connected in a belt as with the other patents described above. Shells are positioned within lined slots of the mechanism and movement of the slot liner moves the shells out of the slots for feeding to the gun during operation.

DISCLOSURE OF INVENTION

An object of the present invention is to provide improved apparatus for storing and feeding an ammunition belt to an automatic gun.

In carrying out the above object and other objects of the invention, the apparatus includes a storage compartment for an ammunition belt that is adapted to feed an automatic gun upon movement of the belt through the compartment in a feed direction. Dividers are spaced along the feed direction within the compartment and mounted for movement between first and second positions. In the first positions, the dividers extend across the feed direction so as to provide storage of the ammunition belt in a serpentine configuration. The dividers are movable to the second positions thereof extending along the feed direction upon operation of the gun so as to allow the ammunition belt to pass thereby upon movement to the gun.

In the preferred construction, the dividers are mounted on a floor of the compartment by pivotal supports for pivotal movement between the first positions extending upwardly from the floor and the second positions extending along the floor in the feed direction. Each pivotal support preferably has a detent for initially locating the divider supported thereby in its first position during loading of the ammunition belt within the compartment. After loading, the detents allow movement of the belt in the feed direction and concomitant movement of the dividers to the second positions upon operation of the gun. Undetenting of the dividers is preferably accomplished by a closure member of the compartment such that movement of the closure member to a closed position releases the dividers for movement from the first positions to the second positions.

Each pivotal support for the dividers includes at least one bearing and, most preferably, includes a pair of bearings that pivotally mount the associated divider for movement between its first and second positions. The preferred construction of the dividers includes a blade and a shaft which is secured to the blade and has opposite ends extending therefrom and respectively mounted by the bearings of the associated pivotal support for axial movement as well as the pivotal movement between the first and second positions. One bearing of each pivotal support includes the detent thereof which is embodied by a notch for receiving the divider blade to provide the detenting in the first position. Axial movement of the shaft moves the divider blade out of the detent notch so as to allow movement of the divider to the second position. Helical springs which provide a means for biasing the dividers extend about the shaft ends thereof opposite the shaft ends that are received by the bearings having the detent notches. Each helical spring has a first end that engages the divider blade and a second end that engages the other bearing of each pivotal support so as to bias the dividers toward the detent notches. Closing of the compartment closure engages the closure with the shaft ends supported by the bearings having the detent notches and axially moves the dividers so as to provide the undetenting thereof which allows the movement to the second positions of the dividers upon operation of the gun.

Slide clips of the apparatus are respectively associated with the bearings to facilitate movement of the ammunition belt over each pivotal support. Each slide clip includes a mounting leg secured between the compartment floor and the associated bearing and also includes a slide leg that extends from the mounting leg thereof over the bearing along the feed direction. The dividers have a length which is greater than the spacing between the support bearings of each pivotal support such that the free end of each divider blade extends over the shaft of the next adjacent divider in the second position. When so positioned, the free end of each divider is located between the slide clips of the pivotal support bearing that mount the next adjacent divider.

The objects, features, and advantages of the present invention are readily apparent from the following description of the best mode for carrying out the invention when taken in connection with the accompanying drawings.

BEST MODE FOR CARRYING OUT THE INVENTION

Figure 1:
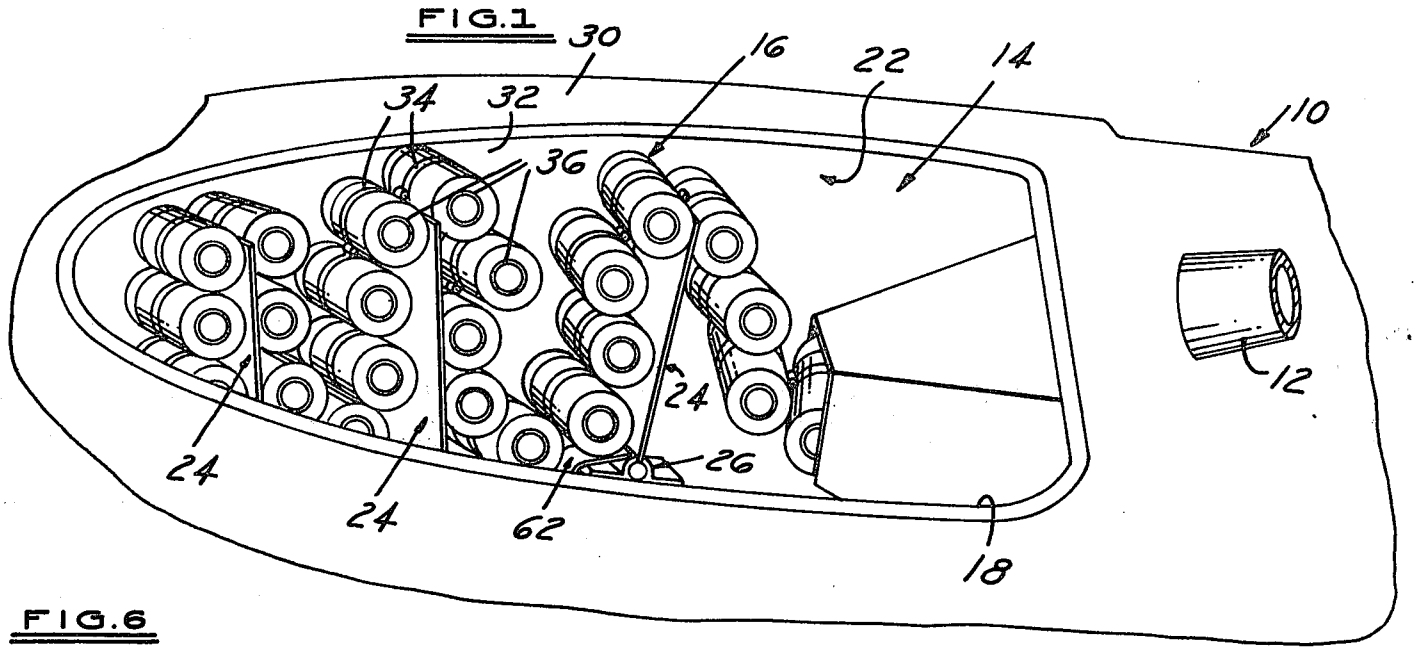
FIG. 1 is a perspective view of a gun turret which incorporates apparatus for storing and feeding an ammunition belt in accordance with the present invention.

Referring to FIG. 1 of the drawings, a gun turret indicated by reference numeral 10 includes an automatic gun 12 and apparatus indicated collectively by 14 for feeding an ammunition belt 16 to the gun. Gun turret 10 includes a hatch opening 18 which is opened and closed by a movable hatch cover (not shown) and defines a storage compartment 22 that extends about the perimeter of the turret and receives the ammunition belt 16. A plurality of dividers 24 are spaced along the compartment and provide storage of the belt 16 in the serpentine configuration shown. Upon operation of the gun 12, the dividers 24 move downwardly in a feed direction, to the right as shown, so that the ammunition belt 16 can move thereover to feed the gun.

Figure 2:
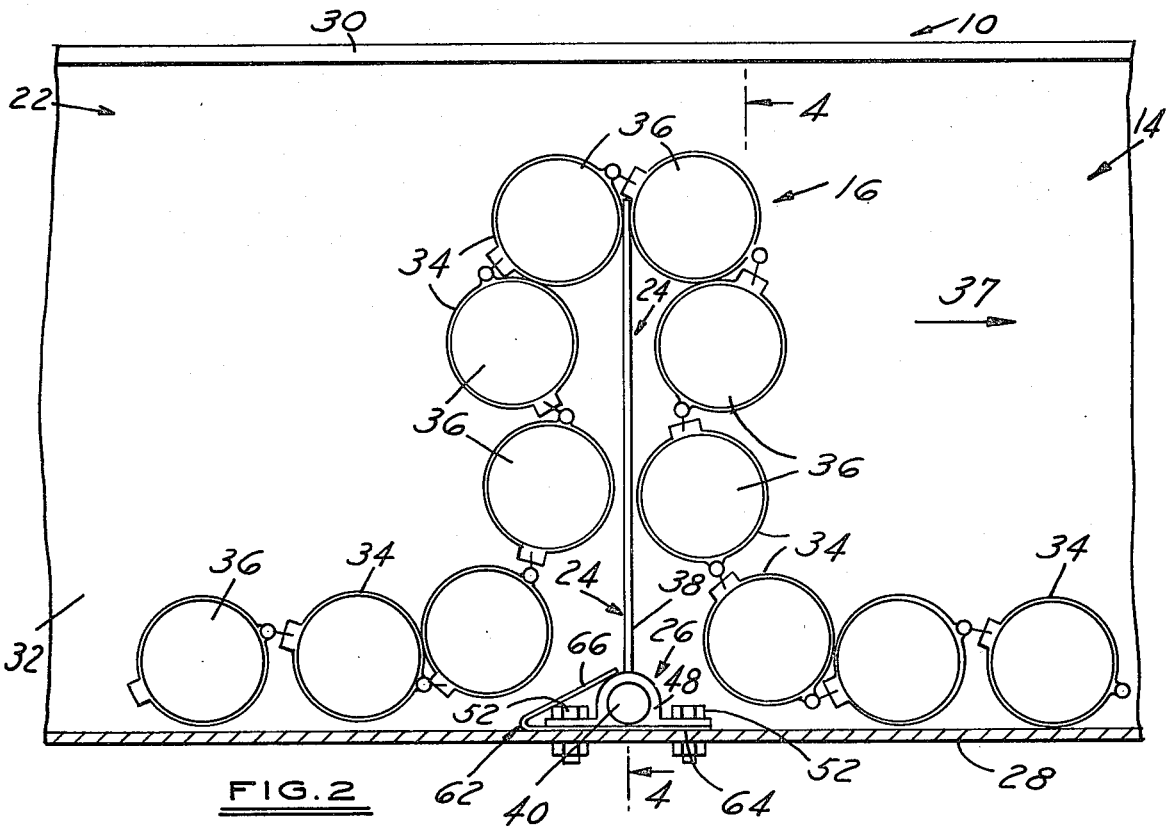
FIG. 2 is a view taken within the turret looking outwardly at an ammunition belt storage compartment of the apparatus and shows a divider of the compartment located in a first position thereof.
Figure 3:
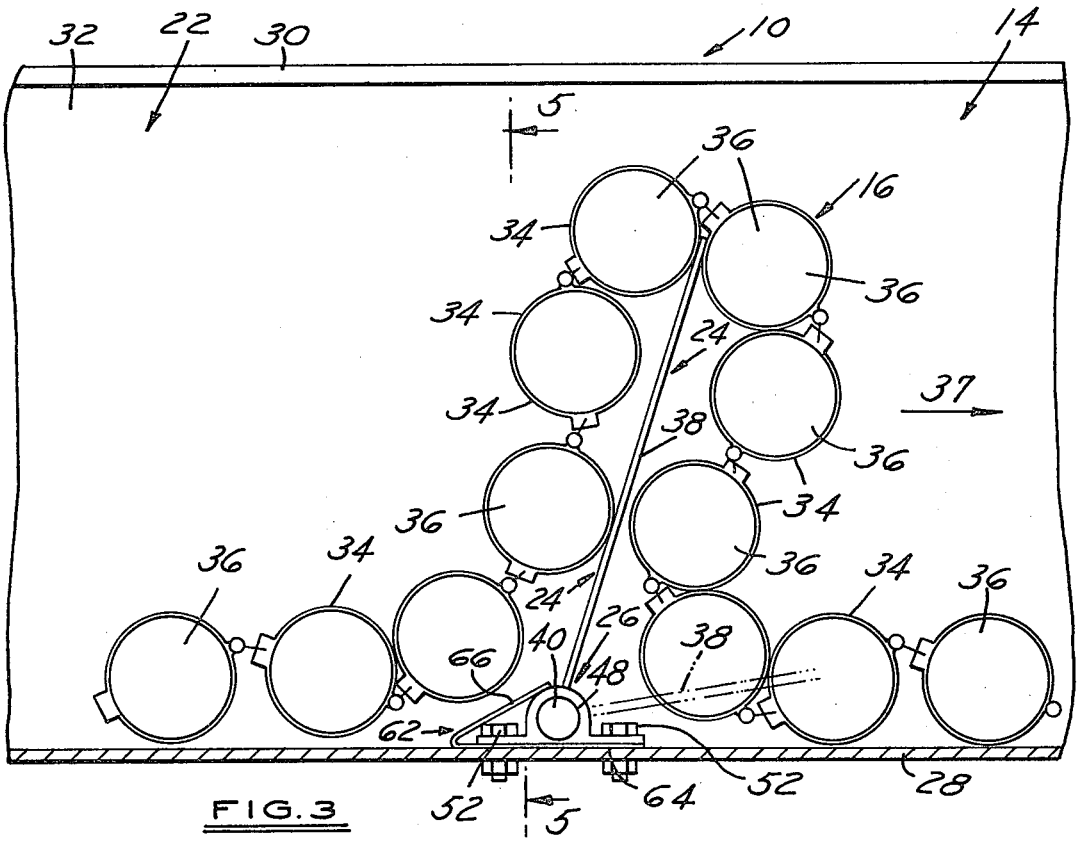
FIG. 3 is a view similar to FIG. 2 but with the divider undetented so that it can move to a second position shown by phantom line representation as the ammunition belt is fed to the turret gun.

Referring to FIGS. 2 and 3, each divider 24 includes a pivotal support 26 that provides a means for mounting the divider on a floor 28 of compartment 22 extending upwardly in a first position shown by FIG. 2 across the direction in which the ammunition belt 16 is fed to the gun. Divider detents which will subsequently be described locate the dividers as shown in FIG. 2 during loading of the ammunition belt 16 into the compartment 22 below an upper wall 30 thereof and inwardly of an outer turret wall 32 that extends between the floor 28 and the upper wall 30. After loading, the ammunition belt extends upwardly from the floor 28 over each divider 24 and downwardly to the next divider in the serpentine configuration shown in FIG. 1. U-shaped portions of the belt 16 are thus received between each adjacent pair of dividers with the legs of each portion spaced from each other. There is no engagement between the belt connectors 34 that interconnect the shells 36 of the ammunition belt 16 due to the separation of the U-shaped portions of the ammunition belt from each other in the stored condition by the dividers.

After loading of the ammunition belt, the dividers 24 are undetented in a manner which will be more fully hereinafter described and the weight of the ammunition belt 16 then maintains the dividers in the first positions thereof, as shown in FIG. 3, extending upwardly from the floor 28 across the feed direction but slightly inclined with respect to the vertical. Feeding of the belt 16 to the gun takes place along the feed direction shown by arrow 37 and the dividers 24 then successively move downwardly to the phantom line position as the ammunition belt 16 passes over each divider. During the feeding, the dividers prevent engagement of the shell connectors 34 with each other so as to minimize the force required to feed the belt and prevent any possibility of the shells becoming entangled with each other and consequent termination of the gun firing.

Figure 4:
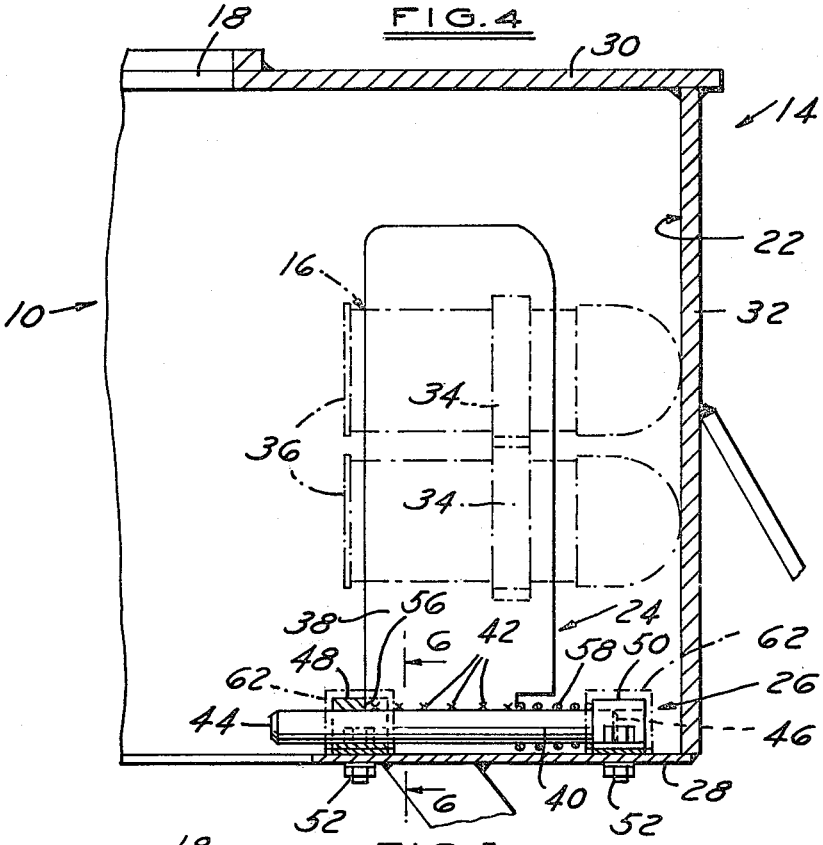
FIG. 4 is a view of the apparatus taken along line 4—4 of FIG. 2.
Figure 5:
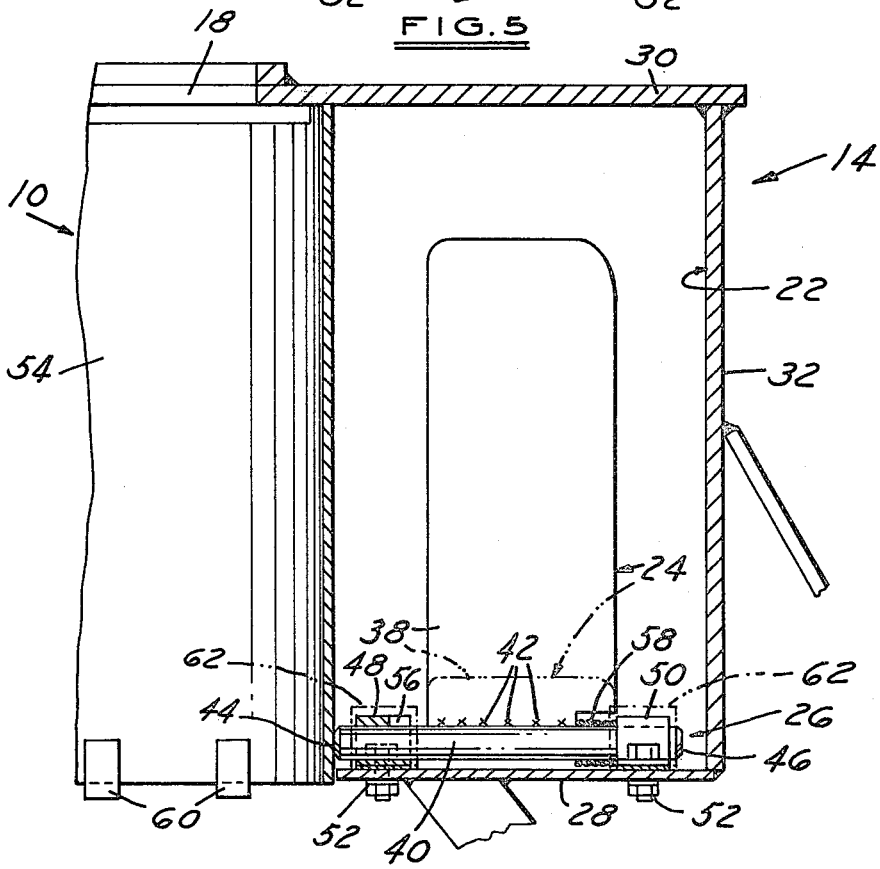
FIG. 5 is a view of the apparatus taken along line 5—5 of FIG. 3.

With combined reference to FIGS. 2 through 5, each divider 24 preferably includes an elongated blade 38 and a shaft 40 that is secured to the blade in any suitable manner such as the welds 42 shown in FIGS. 4 and 5. Opposite ends 44 and 46 of each shaft 40, as shown in the two latter views, are respectively supported by a pair of bearings 48 and 50 of the associated pivotal support 26. Each bearing is secured by a pair of nut and bolt connections 52 to the compartment floor 28 and receives the associated shaft end to allow axial movement of the shaft 40 as well as the pivotal movement thereof previously described.

Figure 7:
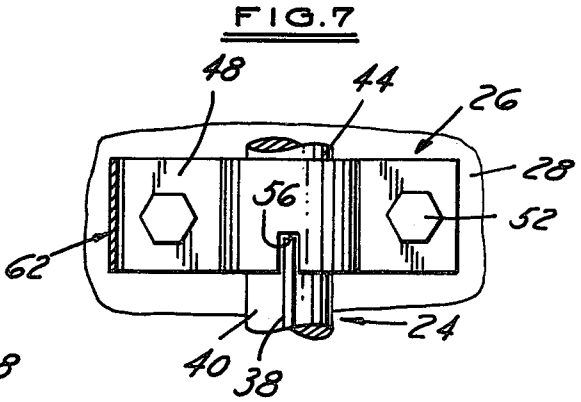
FIG. 7 is a partially broken away top plan view of the pivotal support taken along line 7—7 of FIG. 6.
Figure 6:
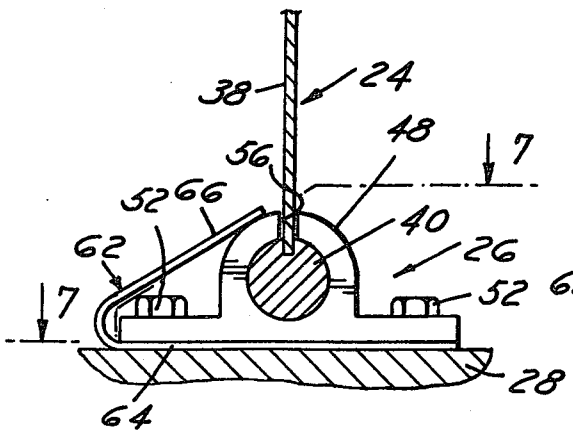
FIG. 6 is a view taken partially in section through a pivotal support of the divider along line 6—6 of FIG. 4.

During loading of the ammunition belt 16, a closure 54 (FIG. 5) for the compartment 22 is removed as shown in FIG. 4 so as to provide access to the compartment. In this condition, each divider 24 is maintained in a detented relationship by the cooperable action of a detent on the associated bearing 48 in the form of a detent notch 56 and a helical spring 58 located on the opposite side of the divider blade 38 as the detent notch. Each spring 58 has a first end that engages the divider blade 38 and a second end that is seated against the other bearing 50 so as to bias the divider inwardly and position the divider blade within the detent notch 56 as shown in FIGS. 4, 6, and 7. This detenting locates the divider with its blade 38 in the upstanding position shown by FIG. 2 as the ammunition belt 16 is loaded into the compartment 22 in the serpentine configuration previously described. As the compartment closure 54 is moved to the closed position shown in FIG. 5 and secured by the latches 60 shown, the closure engages the shaft ends 44 and moves the shafts 40 axially within the bearings 48 and 50 against the bias of the helical springs 58. Each divider blade 38 is moved out of the associate detent notch 56 by this axial movement of the shafts so that the dividers are then free to move downwardly for feeding of the ammunition belt in the manner previously described.

Figure 8:
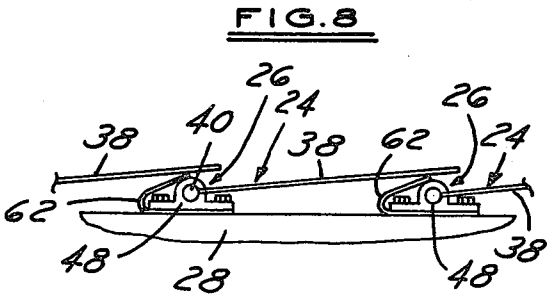
FIG. 8 is a schematic view which illustrates the manner in which the dividers extend over each other upon feeding of the ammunition belt to the gun.

As seen in FIGS. 3 and 5, each bearing 48 and 50 includes a slide clip 62 for facilitating movement of the ammunition belt over the bearing with the divider 24 associated therewith located in its downwardly extending position along the feed direction. A mounting leg 64 of each slide clip is secured between the associated bearing and the compartment floor 26 by the nut and bolt connections 52 and supports a slide leg 66 of the clip which extends upwardly and along the feed direction over the bearing. The slide clips 62 are spaced axially from each other along the length of the associated divider shaft 40 a slightly greater distance than the width of each divider blade 38. Each blade 38 has a length between its mounted end and its free end which is slightly greater than the spacing between the adjacent pivotal supports 26 as shown in FIG. 8. Consequently, upon movement of the divider blades downwardly during feeding of the ammunition belt 16, the free end of each blade 38 is received between the slide clips 62 of the next adjacent pivotal support and is positioned above the shaft 40 of the divider supported by the next support. Belt movement in the feed direction is thus facilitated by the construction of the pivotal supports 26 and the construction of the dividers 24 and the cooperation therebetween along with the slide clip 62.

While the best mode for practicing the invention has herein been described in detail, those familiar with this art will recognize various alternative designs and embodiments for practicing the invention as defined by the following claims.

What is claimed is:

1. Apparatus for storing and feeding an ammunition belt comprising: a storage compartment for an ammunition belt that is adapted to feed an automatic gun upon movement of the belt through the compartment in a feed direction; a plurality of dividers spaced along the feed direction within the compartment; means mounting the dividers within the compartment for movement between first and second positions; the dividers extending across the feed direction in the first positions thereof so as to provide storage of the ammunition belt in a serpentine configuration within the compartment; the dividers being movable to the second positions thereof extending along the feed direction so as to allow the ammunition belt to pass thereby upon movement to the gun; each divider including a detent for initially providing positioning thereof in the first position during loading of the ammunition belt within the compartment; and a closure for the compartment movable to a closed position to undetent the detent and thereby permit movement of dividers to the second positions thereof as the stored ammunition belt moves to the gun.

2. Apparatus for storing and feeding an ammunition belt comprising: a storage compartment for an ammunition belt that is adapted to feed an automatic gun upon movement of the belt through the compartment in a feed direction; said compartment having a lower floor above which the ammunition belt is stored within the compartment; a plurality of dividers spaced on the compartment floor along the feed direction of the ammunition belt; a support for mounting each divider on the compartment floor for movement between first and second positions; the dividers extending upwardly from the floor in the first positions thereof so as to provide storage of the ammunition belt in a serpentine configuration; the dividers being movable to the second positions thereof extending along the feed direction to allow the ammunition belt to move thereover to the gun; each support having a detent for initially locating the associated divider in the first position thereof during loading of the ammunition belt within the compartment; and a closure for the compartment movable to a closed position to undetent the detents and thereby permit movement of the belt in the feed direction to the gun and concomitant movement of the dividers to the second position.

3. Apparatus as in claim 2 wherein each support includes at least one bearing that pivotally mounts the associated divider for movement between its first and second positions.

4. Apparatus for storing and feeding an ammunition belt comprising: a storage compartment for an ammunition belt that is adapted to feed an automatic gun upon movement of the belt through the compartment in a feed direction; said compartment having a lower floor above which the ammunition belt is stored within the compartment; a plurality of dividers spaced on the compartment floor along the feed direction of the ammunition belt; a support for mounting each divider on the compartment floor for movement between first and second positions; the dividers extending upwardly from the floor in the first positions thereof so as to provide storage of the ammunition belt in a serpentine configuration; the dividers being movable to the second positions thereof extending along the feed direction to allow the ammunition belt to move thereover to the gun; each support having a detent for initially locating the associated divider in the first position thereof during loading of the ammunition belt within the compartment and for subsequently allowing movement of the belt in the feed direction and concomitant movement of the dividers to the second position; each support including at least one bearing that pivotally mounts the associated divider for movement between its first and second positions; each divider including a blade and a shaft which is secured to the blade thereof and mounted by the associated support bearing for axial movement; the detent of each support including a notch in the one support bearing thereof for receiving the divider blade to provide the detenting thereof in the first position; and the shaft of each divider being movable axially to move the divider blade out of the detent notch so as to allow movement of the divider toward the second position.

5. Apparatus as in claim 4 further including biasing means for biasing each divider toward the detent notch in the associated support bearing and further including a compartment closure for closing the ammunition compartment and concomitantly moving the dividers against the biasing means so as to move the blades of the dividers out of their associated detent notches.

6. Apparatus as in claim 5 wherein the biasing means includes a plurality of springs that respectively bias the dividers.

7. Apparatus as in claim 6 wherein each spring has a helical shape and receives the divider shaft, each spring having a first end that engages the associated divider blade and a second end located on the opposite side of the first end thereof as the detent notch, and each divider support including a second bearing that engages the second end of the associated biasing spring.

8. Apparatus as in claims 3 or 7 further including slide clips associated with each bearing to facilitate movement of the ammunition belt thereover.

9. Apparatus as in claim 8 wherein each slide clip includes a mounting leg secured between the compartment floor and the associated bearing and also includes a slide leg extending from the mounting leg over the bearing along the feed direction.

10. Apparatus as in claim 3 wherein the dividers have a length greater than the spacing between the support bearings thereof such that each divider extends post the bearings of the next adjacent divider in the second position thereof.

11. Apparatus for storing and feeding an ammunition belt comprising: a compartment for an ammunition belt that is adapted to feed an automatic gun upon movement of the belt through the compartment in a feed direction; said compartment having a lower floor above which the ammunition belt is stored within the compartment; a plurality of dividers spaced on the compartment floor along the feed direction of the ammunition belt; a pivotal support mounting each divider on the compartment floor for movement between first and second pivotal positions and for axial movement along the pivotal axis thereof; the dividers extending upwardly from the floor in the first positions thereof so as to provide storage of the ammunition belt in a serpentine configuration; the dividers being movable to the second positions thereof extending along the feed direction to allow the ammunition belt to move thereover to the gun; detents for respectively engaging the dividers to provide detenting in the first positions thereof; springs for biasing the dividers axially into engagement with the detents; and a compartment closure for closing the compartment and concomitantly moving the dividers against the bias of the springs out of engagement with the detents.

12. Apparatus for storing and feeding an ammunition belt comprising: a compartment for an ammunition belt that is adapted to feed an automatic gun upon movement of the belt through the compartment in a feed direction; said compartment having a lower floor above which the ammunition belt is stored within the compartment; a plurality of dividers spaced on the compartment floor along the feed direction of the ammunition belt; each divider including a blade of an elongated shape and a shaft which is secured to the blade thereof; the shaft of each divider having opposite ends extending from the blade secured thereto; a pivotal support including pairs of bearings mounting the shaft ends of the dividers on the compartment floor for movement between first and second pivotal positions for axial movement along the pivotal axes thereof; the dividers extending upwardly from the floor in the first positions thereof so as to provide storage of the ammunition belt in a serpentine configuration; the dividers being movable to the second positions thereof extending along the feed direction to allow the ammunition belt to move thereover to the gun; one bearing of each pair having a detent notch for receiving the blade of the associated divider upon axial movement so as to provide detenting of the divider in the first position thereof; helical springs for biasing the dividers axially toward the associated detent notches; each helical spring extending about the shaft end which is supported by the other bearing of each pair; each helical spring having a first end that engages the blade of the associated divider and a second end which engages the other bearing which supports the shaft end about which the spring extends; and a compartment closure for closing the compartment and concomitantly engaging the shaft ends supported by the bearings having the detent notches so as to move the dividers against the bias of the helical springs and thereby move the blades of the dividers out of the detent notches.

13. Apparatus for storing and feeding an ammunition belt comprising: a compartment for an ammunition belt that is adapted to feed an automatic gun upon movement of the belt through the compartment in a feed direction; said compartment having a lower floor above which the ammunition belt is stored within the compartment; a plurality of dividers spaced on the compartment floor along the feed direction of the ammunition belt; a pivotal support mounting each divider on the compartment floor for movement between first and second pivotal positions and for axial movement along the pivotal axis thereof; the dividers extending upwardly from the floor in the first positions thereof so as to provide storage of the ammunition belt in a serpentine configuration; the dividers being movable to the second positions thereof extending along the feed direction to allow the ammunition belt to move thereover to the gun; a slide clip for each pivotal support so as to facilitate movement of the ammunition belt thereover; detents for respectively engaging the dividers to provide detenting in the first positions thereof; springs for biasing the dividers axially into engagement with the detents; and a compartment closure for closing the compartment and concomitantly moving the dividers against the bias of the springs out of engagement with the detents.

14. Apparatus for storing and feeding an ammunition belt comprising: a compartment for an ammunition belt that is adapted to feed an automatic gun upon movement of the belt through the compartment in a feed direction; said compartment having a lower floor above which the ammunition belt is stored within the compartment; a plurality of dividers spaced on the compartment floor along the feed direction of the ammunition belt; each divider including a blade of an elongated shape and a shaft secured to the blade; each shaft having opposite ends extending from the blade secured thereto; a pivotal support for each divider including a pair of bearings mounting the shaft ends of the divider on the compartment floor for movement between first and second pivotal positions and for axial movement along the pivotal axis thereof; the dividers extending upwardly from the floor in the first positions thereof so as to provide storage of the ammunition belt in a serpentine configuration; the dividers being movable to the second positions thereof extending along the feed direction to allow the ammunition belt to move thereover to the gun; the bearings of adjacent pivotal supports being spaced close enough to each other so that the blade of each divider in the second position thereof extends over the shaft of the next adjacent divider; each bearing including a slide clip having a mounting leg secured between the bearing and the floor and also including a slide leg extending from the mounting leg thereof over the bearing to facilitate movement of the ammunition belt in the feed direction; one bearing of each pair having a detent notch for receiving the blade of the associated divider upon axial movement thereof so as to provide detenting of the divider in the first position thereof; helical springs for biasing the dividers axially toward the associated detent notches; each helical spring extending about the shaft end which is supported by the other bearing of each pair; each helical spring having a first end that engages the blade of the associated divider and a second end which engages the bearing that supports the shaft end about which the spring extends; and a compartment closure for closing the compartment and concomitantly engaging the shaft ends supported by the bearing having the detent notches so as to move the dividers against the bias of the helical springs and thereby move the blade of the dividers out of the detent notches.

* * * * *